US006604721B2

(12) United States Patent
Ahl et al.

(10) Patent No.: US 6,604,721 B2
(45) Date of Patent: Aug. 12, 2003

(54) BRACKET ASSEMBLY FOR ATTACHING A CONTAINER TO A LADDER

(75) Inventors: Frank E. Ahl, Elliston, MT (US); Brian E. Ahl, Elliston, MT (US); Leonard B. Eckel, Clancy, MT (US); William Rapagnani, Bountiful, UT (US)

(73) Assignee: Ahl, Inc., Elliston, MT (US)

( * ) Notice: Subject to any disclaimer, the term of this patent is extended or adjusted under 35 U.S.C. 154(b) by 0 days.

(21) Appl. No.: 10/108,060

(22) Filed: Mar. 26, 2002

(65) Prior Publication Data

US 2002/0100848 A1 Aug. 1, 2002

Related U.S. Application Data

(63) Continuation-in-part of application No. 09/771,134, filed on Jan. 26, 2001, now Pat. No. 6,382,354.

(60) Provisional application No. 60/192,781, filed on Mar. 28, 2000, and provisional application No. 60/305,165, filed on Jul. 13, 2001.

(51) Int. Cl.[7] ..... E06C 7/14

(52) U.S. Cl. ..... 248/210; 182/129

(58) Field of Search ..... 248/210, 211, 248/217.1, 238; 182/129; D25/68; 224/555, 560

(56) References Cited

U.S. PATENT DOCUMENTS

| | | | | | |
|---|---|---|---|---|---|
| 787,911 | A | * | 4/1905 | Gerhardt et al. | 248/210 |
| 2,541,390 | A | * | 2/1951 | Weigand | 248/210 |
| 2,601,413 | A | * | 6/1952 | Miles | 248/211 |
| 2,932,544 | A | * | 4/1960 | Lambert | 297/163 |
| 3,013,759 | A | * | 12/1961 | Close | 248/218.4 |
| 3,175,743 | A | * | 3/1965 | Richard | 224/549 |
| 3,272,467 | A | | 9/1966 | Kassube | |
| 3,474,996 | A | * | 10/1969 | Stamm | 248/210 |
| 3,593,951 | A | | 7/1971 | Warner et al. | |
| 3,661,351 | A | * | 5/1972 | Olsen | 248/210 |
| 3,837,034 | A | * | 9/1974 | Leffert et al. | 15/257.06 |
| D272,415 | S | * | 1/1984 | Case | D8/373 |
| 4,527,763 | A | * | 7/1985 | Woytowich | 248/238 |
| 4,984,763 | A | * | 1/1991 | O'Donnell | 248/218.1 |
| 5,305,977 | A | * | 4/1994 | Roth | 248/210 |
| 5,379,536 | A | * | 1/1995 | Lorenzana | 38/106 |
| 5,493,751 | A | | 2/1996 | Misiukowiec et al. | |
| 5,865,409 | A | * | 2/1999 | Nimer | 248/210 |

FOREIGN PATENT DOCUMENTS

FR 2633201 * 12/1989

* cited by examiner

*Primary Examiner*—Ramon O. Ramirez
*Assistant Examiner*—Jon Szumny
(74) *Attorney, Agent, or Firm*—Saliwanchik, Lloyd & Saliwanchik

(57) ABSTRACT

A bracket pivotally mounted on a bracket support is used to removably attach a container to the side of a ladder. The bracket and bracket support are affixed to the container by attachment means. In a preferred embodiment, the bracket support is integral to the container and is a lip disposed on an upstanding peripheral wall. The container includes a bottom panel and an upstanding peripheral wall defining the interior of the container. The lip is disposed on the upstanding peripheral wall proximate to the top portion of the upstanding peripheral wall. The lip extends laterally outward from the upstanding peripheral wall and includes an outward facing rail contact surface. Pivot supports disposed at a position intermediate the rail contact surface of the lip and the first wall section of the container attach a bracket to the lip. The U-shaped bracket includes a rail engaging section disposed outwardly from the rail contact surface of the lip at a spaced apart lateral distance from the rail contact surface of the lip. The spaced apart distance defines a ladder rail receiving gap. The bracket is freely rotatable within the pivot supports from at least a first position where the bracket is supported by the lip to a second position where the bracket has rotated upwardly from the lip and the lateral distance between the bracket rail engaging section and the rail contact surface has shortened. In the second position, the bracket is able to pinch a ladder rail between the bracket rail engaging section and the rail contact surface of the lip.

17 Claims, 21 Drawing Sheets

BRACKET ASSEMBLY FOR ATTACHING A CONTAINER TO A LADDER

REFERENCE TO RELATED APPLICATIONS

The subject application is a continuation-in-part of application Ser. No. 09/771,134, filed Jan. 26, 2001 now U.S. Pat. No. 6,382,354 which was based on provisional application Ser. No. 60/192,781, filed Mar. 28, 2000. This application also claims priority to provisional application Ser. No. 60/305,165, filed Jul. 13, 2001. The disclosures of each of these applications are hereby incorporated by reference in their entirety, including all figures, tables, and drawings.

BACKGROUND OF THE INVENTION

Much of the work done by carpenters, painters, electricians and plumbers is carried out on a ladder. Equipment, tools and supplies are used by these professionals as they are perched atop the ladders. Juggling these materials as workers ascend, descend and work atop the ladder can create precarious situations. Containers that can be secured to a ladder and hold materials and equipment allow the professional to work safely on the ladder and reduce the number of trips up and down the ladder to re-supply.

Containers supported by or attachable to ladders which are suitable for holding hardware or paint have existed in various configuration for years. These containers typically utilize means that permit temporary attachment of the container to a step ladder or an extension ladder. A common problem associated with ladder supported containers is that such containers are often specifically designed to attach to a single type of ladder. Furthermore, these ladder supported containers often only permit attachment to a specific configuration of step ladder or a specific configuration of extension ladder. As many variations of ladders exist in the market place there can be difficulty in finding a proper container that the ladder will accommodate.

Another problem associated with typical ladder supported containers has been that the means utilized to secure the containers to a ladder typically requires attachment either to two steps of a step ladder; to a step of a step ladder and the ladder rail; or to two spaced apart rungs of an extension ladder. Means which secure to the ladder rail only require some disassembly and reassembly or require the use of fasteners. Due to the variations in ladder construction, the means of the containers often have to be adjusted when possible to securely attach the container to a ladder. Where adjustment isn't possible often the container cannot be utilized with particular ladders.

Existing ladder supported containers are often problematic to mount on a ladder because of the necessity to attach them to the ladder at more than one point. Additionally, most ladder supported containers require the user to hold the container with one hand, while attaching the container to the ladder with a second hand. This is particularly difficult when the means by which the container is attached to the ladder includes fasteners. It is both difficult and dangerous to devote both hands to mounting a container to a ladder when the user is standing on the ladder. If the ladder supported container mounts in a manner where the container is not centered on the ladder but is cantilevered off the ladder and attaches to the ladder rail, the attachment process becomes even more difficult and dangerous. In an arrangement of this type the user must lean away from the ladder holding the container while fastening the container to the ladder.

Existing container attachment designs that utilize a single step for securement typically utilize a support on the container which can be attached to a single rung or step and from which the container hangs. A problem associated with this design is the lack of stability of the container that can easily be accidentally moved in relation to the ladder. Furthermore, the devices used to hang the container are located above the container's interior and often block access to the container's interior. Container supports of this type often do not have a secure attachment to the container, as well, and allow the container to swing in relation to the support if the support is used to carry the container up or down the ladder.

Existing ladder supported containers whose means for ladder attachment is integral with the container suffer the problem of instability when the container is not attached to a ladder. Filling a container with paint or other items is difficult as the user must somehow support the container to do so. Use of a container of this type when off the ladder is extremely restricted and often not even possible.

Many containers do not have a handle and require the user to grab on to the container wherever possible. This is problematic to the user who is required to both hold the container while moving up and down the ladder, and to hold the container while securing the container to the ladder. Not finding an adequate area to hold on to the container can be both difficult and dangerous to the user while moving the container or securing it to the ladder.

Container designs that do utilize a handle have problems associated with the use of the handle. Many handles additionally serve as means by which to attach the container to the ladder. In this design the handle is typically located above the container, often obstructing the user from the container itself. Additionally, the user of a container of this type has to mount the handle onto a step or rung and then somehow remove his or her hand from the handle once the handle is attached to the ladder.

Other container designs that also include a handle make the handle only useful when moving up or down the ladder. The handle in these container designs is often unusable during the mounting of the container on the ladder. This requires the user to hold onto a different portion of the container during securement of the container to the ladder, a process which is both difficult and dangerous when standing atop a ladder.

From the foregoing, it is apparent that there is a need for a means by which to attach a container to a ladder securely and easily. The container should securely mount and dismount to different types of ladders, securely mounting to a step ladder, to an extension ladder when fully extended, or to an extension ladder in a position when the ladder sections are overlapping. There is also a need for a ladder supported container that includes a container portion that extends laterally outward from the ladder so as not to interfere with the normal operation of the ladder. There is a further need for a ladder supported container that allows the user to mount the container with one hand only and includes no fasteners and additionally includes no device that will obstruct the user from accessing the container portion of the container.

SUMMARY OF THE INVENTION

The bracket assembly of the subject invention allows a container, such as a bucket, to be removably attached to a ladder. The bracket assembly comprises a bracket disposed within pivot supports on a bracket support. The bracket support has a rail contact surface on one peripheral edge. The bracket support has attachment means for attaching the support to a container.

The bracket securely affixes the bracket assembly and attached container to a ladder laterally so the assembly and container will not interfere with use of the ladder. A bracket is disposed within pivot supports on the bracket support. The bracket is freely rotatable within these pivot supports. A second section of the bracket extends from the first section at a substantially right angle from the first section. A third section extends rearwardly from the second section in a direction substantially at a right angle to the second section and substantially parallel to the first section. The third section is disposed outwardly from the rail contact surface of the bracket support at a spaced apart lateral distance from the rail contact surface of the support. The spaced apart distance defines a ladder rail receiving gap. The bracket further includes a fourth section disposed at the distal end of the bracket and extending from the third section at substantially a right angle to the third section. The bracket first, second, and third section define a "U" shape.

The bracket is freely rotatable within the pivot supports from at least a first position where the bracket second section is supported by the bracket support; to a second position where the second section has rotated upwardly in a clockwise direction from the support. In the second position, the bracket is able to pinch a ladder rail between the bracket third section and the rail contact surface of the support.

The bracket assembly allows a container to be easily mounted to and dismounted from different types of ladders and, will securely mount to a step ladder, to an extension ladder when fully extended, or to an extension ladder in a position when the ladder sections are overlapping. The bracket assembly of the subject invention allows the user to mount the container with one hand only and includes no fasteners and additionally includes no support member that will obstruct the user from accessing the container portion of the container. The ladder supported container extends laterally outward from the ladder so as not to interfere with the normal operation of the ladder.

In a preferred embodiment, the bracket support of the bracket assembly of the subject invention is integral with the container. The container includes a bottom panel and an upstanding peripheral wall. The upstanding peripheral wall typically includes four wall sections which extend upward from the bottom panel. The bottom panel and the upstanding peripheral walls define the interior of the container.

A lip is disposed on the upstanding peripheral wall proximate the top portion of the upstanding peripheral wall. This lip serves as the bracket support. The lip extends laterally outward from the upstanding peripheral wall. A first lip section extends from the first wall section. The first lip section includes an outward facing rail contact surface. The lip extends laterally outward but typically not upward from the peripheral wall of the container. The lip further includes two pivot supports disposed at a position intermediate the rail contact surface of the lip and the first wall section of the container. The bracket is disposed within the pivot supports.

The container of this embodiment is self supporting when the container is not attached to a ladder; and, provides a secure handle for easily holding the container while moving the container, or while securing the container to a ladder which does not interfere with utilizing the container once mounted to a ladder.

DETAILED DESCRIPTION OF THE INVENTION

A bracket mounted on a bracket support captures the rail of a ladder. When attached to a container, such as a bucket, by attachment means, the bracket assembly of the subject invention allows the container to be removably secured to the ladder.

Figure 1:
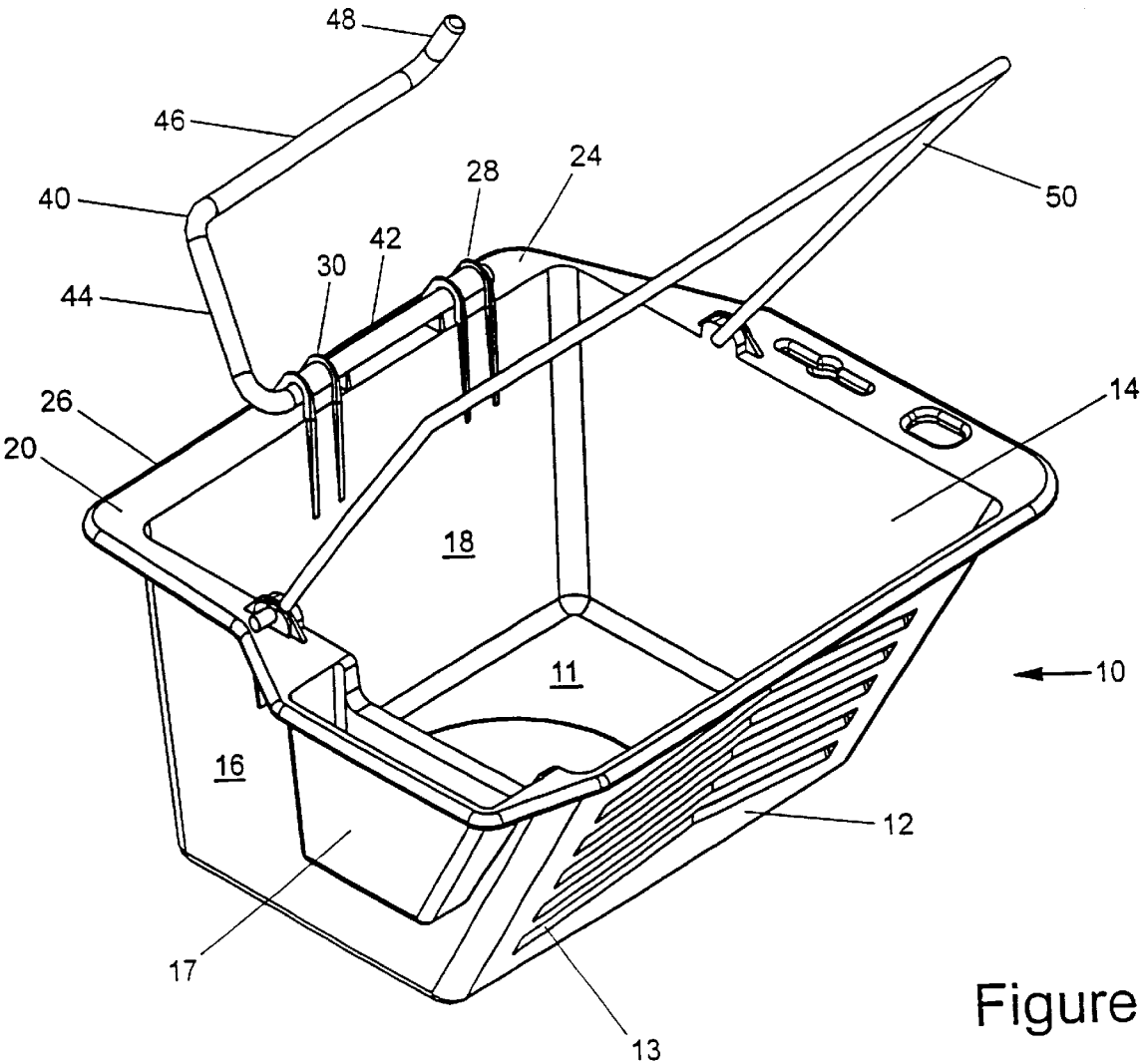
FIG. 1 is a perspective view of a preferred embodiment of the bracket assembly of the subject invention.

In a preferred embodiment, the bracket support is integral with the container and is shown in FIG. 1. A lip on the container serves as the bracket support. The container 10 includes a bottom panel 11 and an upstanding peripheral wall. The upstanding peripheral wall includes four wall sections 12, 14, 16, and 18 which extend upwardly from the bottom panel. Each wall section includes a bottom portion attached to the bottom panel and a top portion. The bottom panel and the upstanding peripheral wall define the interior of the container.

In a particularly preferred embodiment, the wall section 12 includes chevron shaped projections 13 which are useful for engagement by the brush of a paint roller. The wall section 16 includes a brush receptacle 17.

The bracket support is a lip 20 disposed on the upstanding peripheral wall proximate the top portion of the upstanding peripheral wall. The lip 20 extends laterally outward from the upstanding peripheral wall. A first lip section 24 extends from the a first wall section 18. The first lip section 24 includes an outward facing rail contact surface 26. The first lip section 24 having a width defining the distance the lip extends laterally outward from the wall section 18 to the rail contact surface 26 and a length which typically extends the width of the wall section 18. The lip extends laterally outward but not upward from the peripheral wall of the container.

The lip further includes two pivot supports 28 and 30. The pivot supports are disposed at a position intermediate the rail contact surface of the lip and the wall section 18 of the container. The pivot supports 28 and 30 are disposed at a spaced apart distance from the rail contact surface of the lip and the wall section 18. In this embodiment, the pivot supports comprise loops. Any means which provide pivot are however suitable for use as pivot supports, for example, supports can be hinged plates, eyes or rope or wire loops. The pivot supports can be constructed of a number of materials, including but not limited to, wood, metal or plastics. In a particularly preferred embodiment, the bracket support is constructed of a high density polyethylene or super-tough nylon. These materials provide strength and durability to the bracket assembly and are easy to clean and maintain.

A bracket is disposed within the pivot supports 28 and 30. The bracket 40 includes a first section 42 disposed within the pivot supports and freely rotatable within the pivot supports; a second section 44 extending from the first section at substantially a right angle from the first section 42; a third section 46 extending rearwardly from the second section 44 in a direction substantially at a right angle to the second section 44 and substantially parallel to the length of the lip 24. The third section 46 is disposed outwardly from the rail contact surface of the bracket support at a spaced apart lateral distance from the rail contact surface. The spaced apart distance defines a ladder rail receiving gap. The bracket further includes a fourth section 48 disposed at the distal end of the bracket and extending from the third section 46 at substantially a right angle to the third section 46. The bracket first, second and third sections define a "U" shape.

The bracket 40 is freely rotatable within the pivot supports 28 and 30 from at least a first position where the bracket second section 44 is supported by the first lip section 24; to a second position where the second section 44 has rotated upwardly clockwise from the first lip section 24 and the lateral distance between the third section 46 and the rail contact surface 26 has shortened. In FIG. 1, the bracket is shown rotated slightly upwardly away from the first position so that the second section 44 is not supported by the lip.

Also shown in FIG. 1 is a bail 50 that serves as a handle for the container. The bail rotates relative to the container so as to be moved to a position where the bail does not restrict the access to the interior of the container. The bail is removed from the container in FIGS. 2 through 5.

Figure 2:
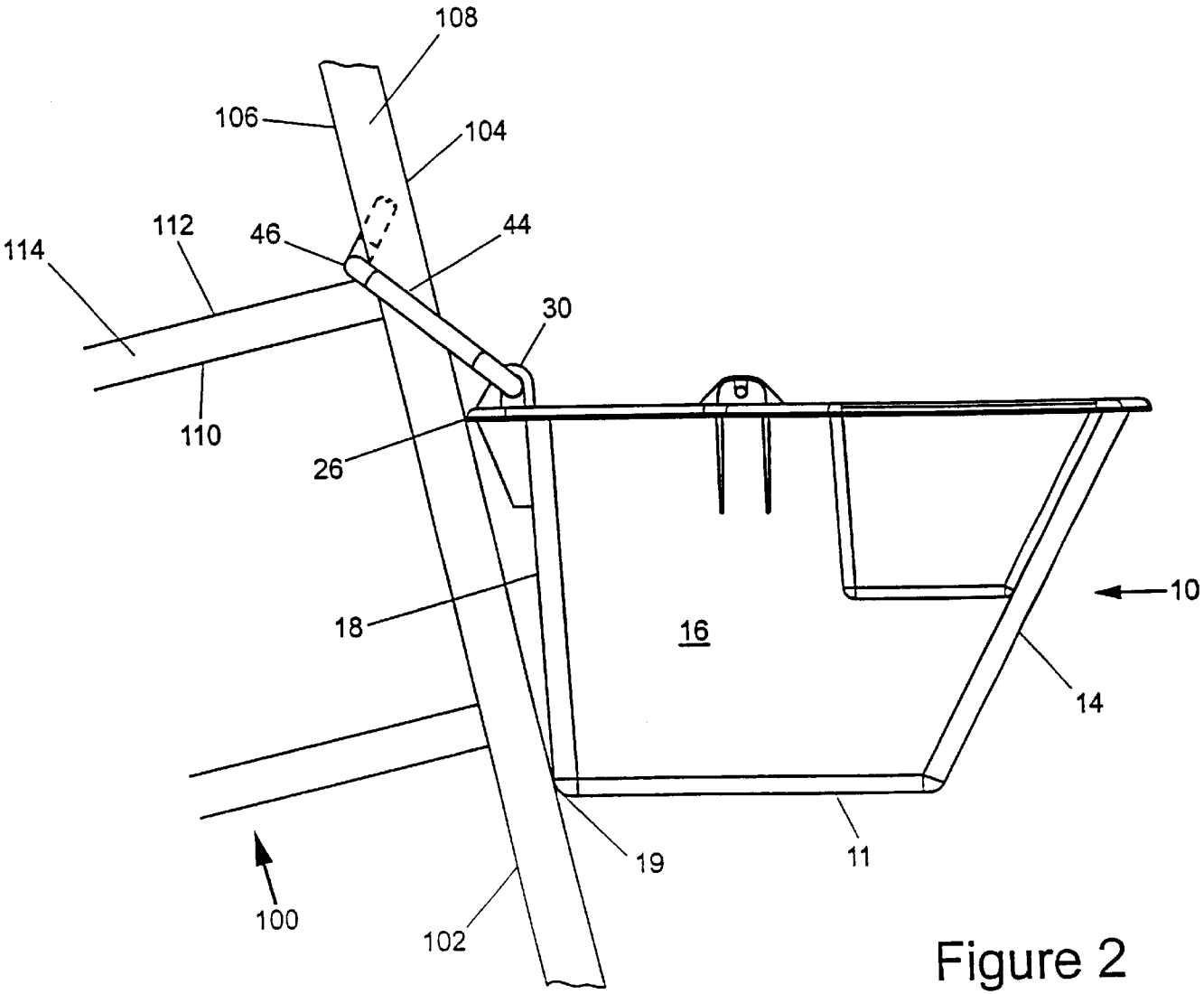
FIG. 2 shows a preferred embodiment of the bracket assembly of the subject invention disposed on a ladder in a front view.

FIG. 2 shows the bracket assembly of the subject invention and container 10 disposed on the ladder 100 from a front view. The ladder includes a rail 102 which includes an outer surface 104, an inner surface 106, and a front surface 108. Not shown in this figure is the back surface 109. The ladder includes a plurality of steps 110. Each step includes a top surface 112 and a front surface 114.

As shown, once the bracket assembly and container 10 are disposed on the ladder 100, the ladder rail 102 is disposed within the rail receiving gap which separates the bracket third section 46 from the rail contact surface 26. The bracket is shown after having rotated clockwise to a second position wherein the ladder rail 102 is pinched between the rail contact surface of the lip 26 and the bracket third section 46. The bracket third section 46 rests atop the top surface 112 of the step 110. The bracket second section 44 is disposed in front of the front surface 108 rail.

Also shown in this view is the position of the bracket fourth section 48, shown in dotted lines as it is hidden by the ladder rail. As will be shown in FIG. 3, as the bracket rotates within the pivot supports, the fourth section moves into engagement with the back surface 109 (not shown in this view) of the ladder rail.

Also shown in FIG. 1, the container, when disposed on the ladder, the bottom 19 of the wall section 18 also contacts the ladder rail. This causes the wall section 18 to be disposed relative to the rail such that the wall section 18 angles outwardly away from the rail contact point at the bottom of the wall as the wall extends upward toward the lip. As the entire container has rotated clockwise so that the bottom 19 of the wall section 18 contacts the ladder rail outer surface 104, the frictional engagement of the bottom 19 of the wall section 18 against the rail outer surface 104 is substantial. This frictional engagement assists the securement of the container to the ladder. Accordingly, the bottom 19 of the wall section 18 is considered to include a rail contact surface.

The orientation of the container, as is shown in FIG. 2, further causes the bottom panel 11 to tilt slightly downwardly away from the ladder rail. Paint will accumulate proximate the joint between the bottom panel 11 and the wall section 14. An accumulation of paint in this area is desirable as it is in the container immediate the angled wall section 14 which includes the roller engagement projections 13.

Figure 3:
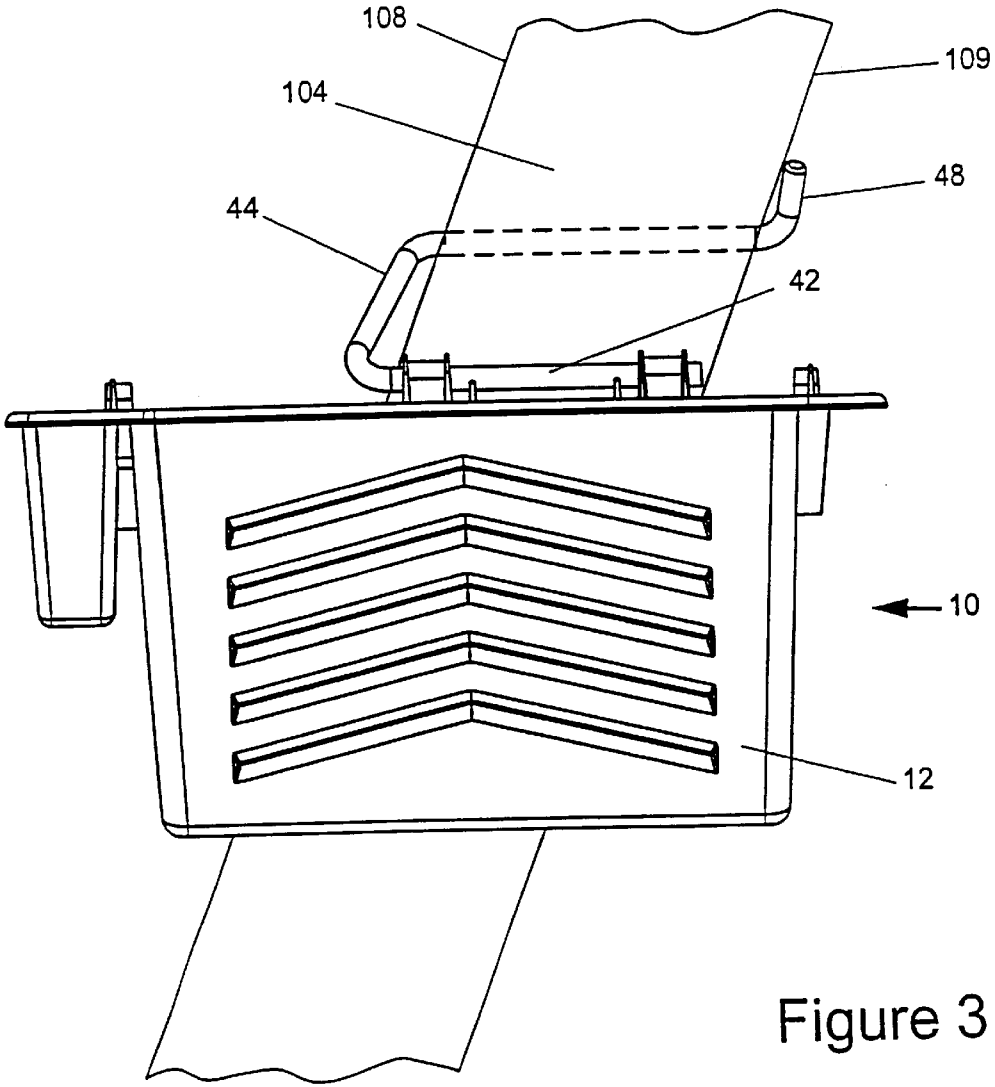
FIG. 3 shows a preferred embodiment of the bracket assembly of the subject invention disposed on the ladder in a side view.

FIG. 3 shows the bracket assembly and container 10 disposed on the ladder from a side view. As is shown in this view, the second section 44 of the bracket is not at an exact right angle with the first section 42. Also shown in this view, is the position of the bracket fourth section 48 in engagement with the back surface 109 of the ladder rail. When the bracket is in this position the container is locked onto the ladder and cannot move unless the container is lifted, resulting in the downward movement (counter clockwise movement) of the bracket.

Figure 4:
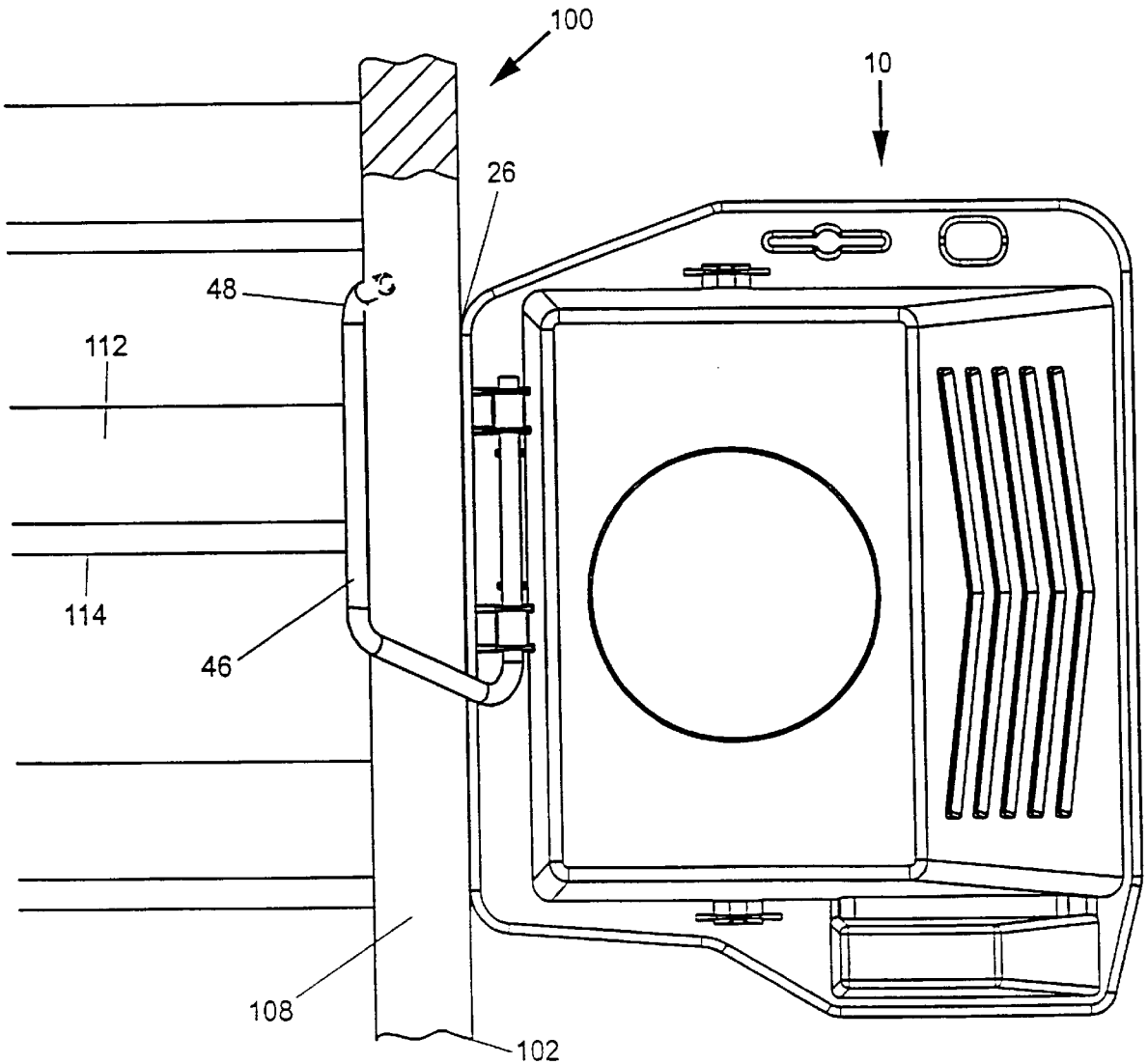
FIG. 4 is a top view showing a preferred embodiment of the bracket assembly of the subject invention disposed on the ladder.

FIG. 4 is a top view showing the bracket assembly and container 10 disposed on the ladder 100. This view shows the ladder rail 102 pinched between the bracket third section 46 and the rail contact surface 26. Also shown is the typical configuration of the steps of commercially available ladders. The ladder top surface 112 and the front surface 114 are shown.

Figure 5:
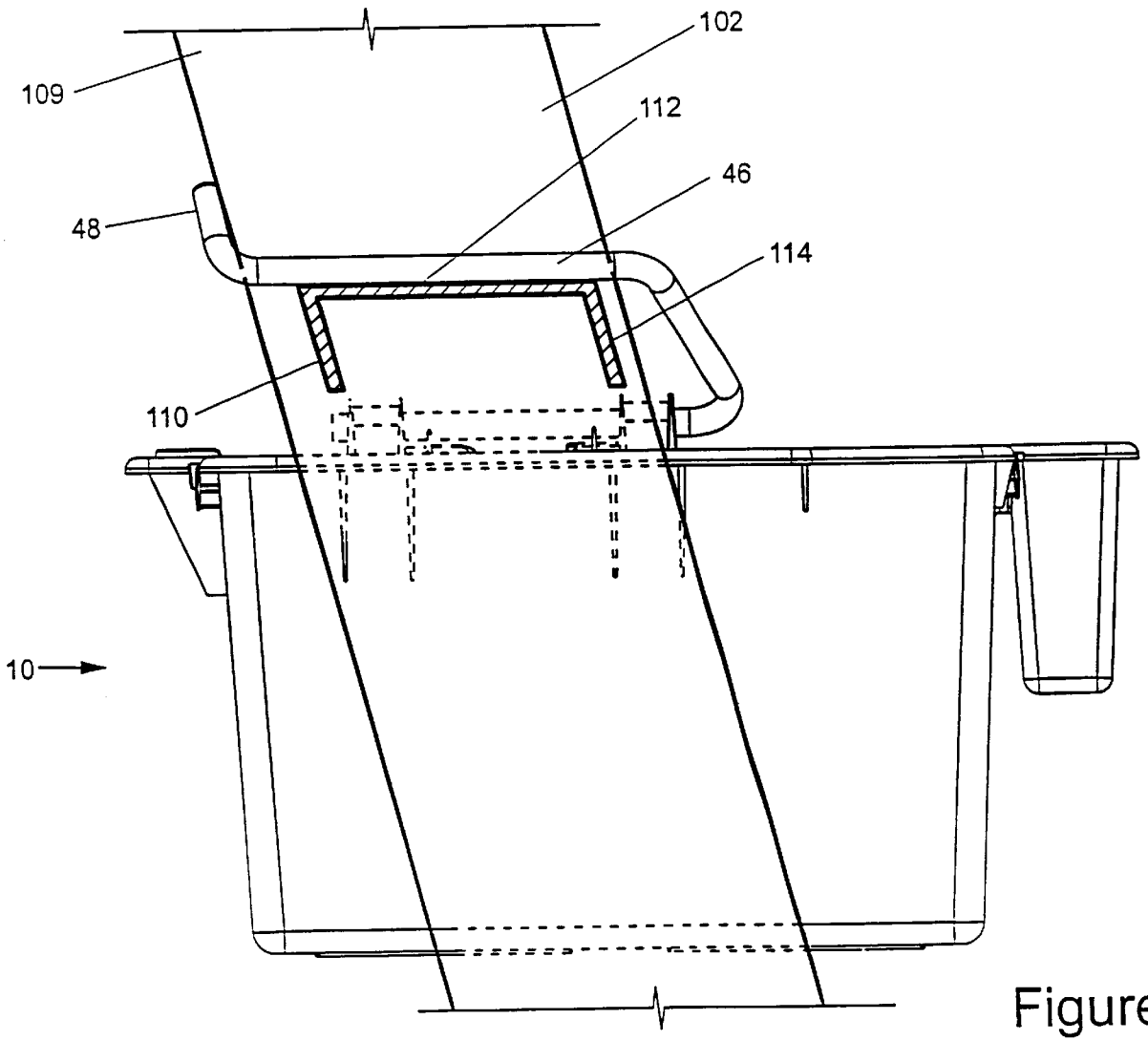
FIG. 5 shows a preferred embodiment of the bracket assembly of the subject invention disposed on the ladder in a side view.
Figure 6:
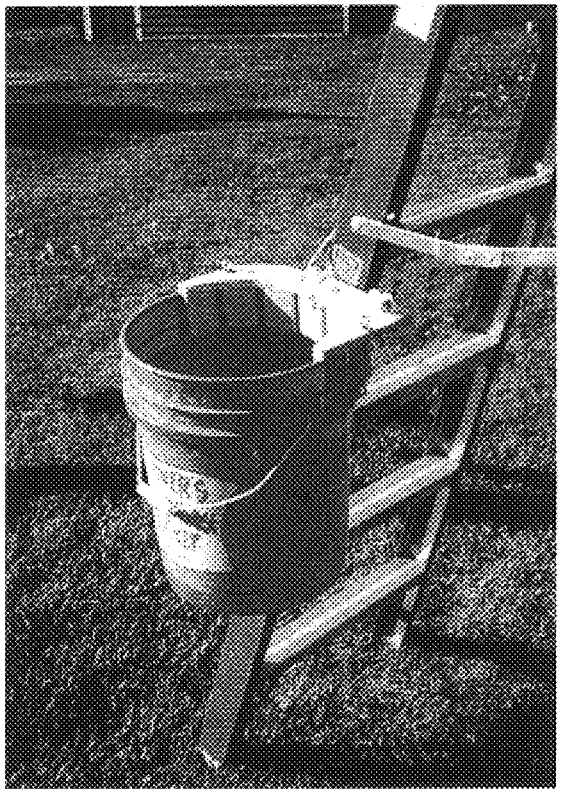
FIG. 6 shows another preferred embodiment of the bracket assembly of the subject invention affixed to a five gallon bucket and attached to a ladder.
Figure 7:
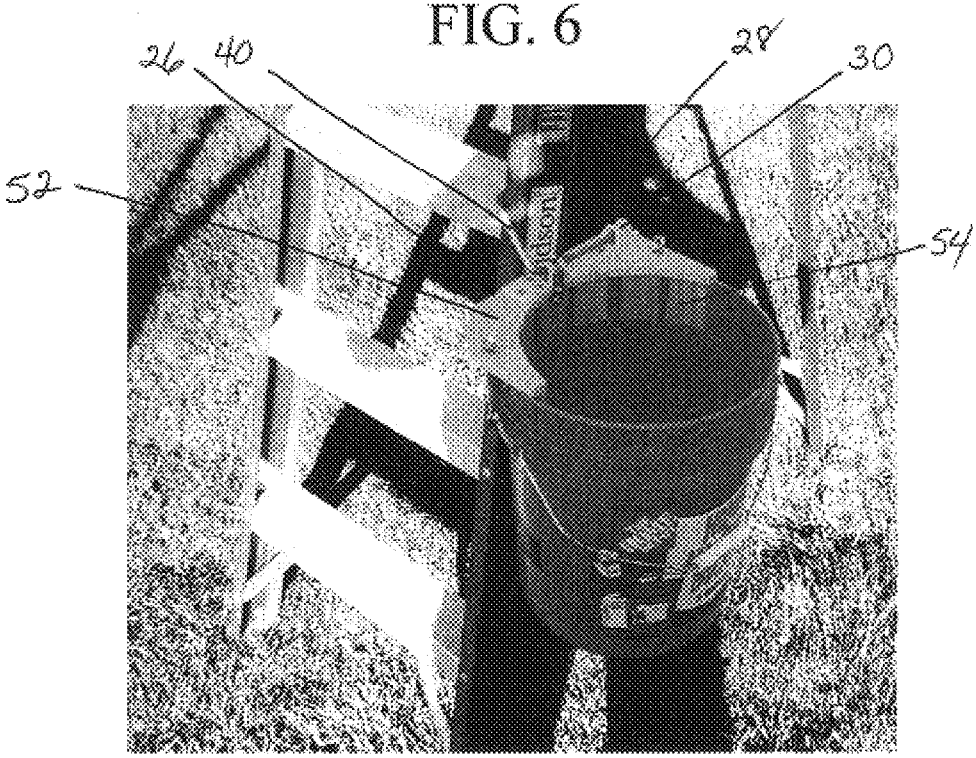
FIG. 7 shows a top perspective view of the embodiment shown in FIG. 6.
Figure 8:
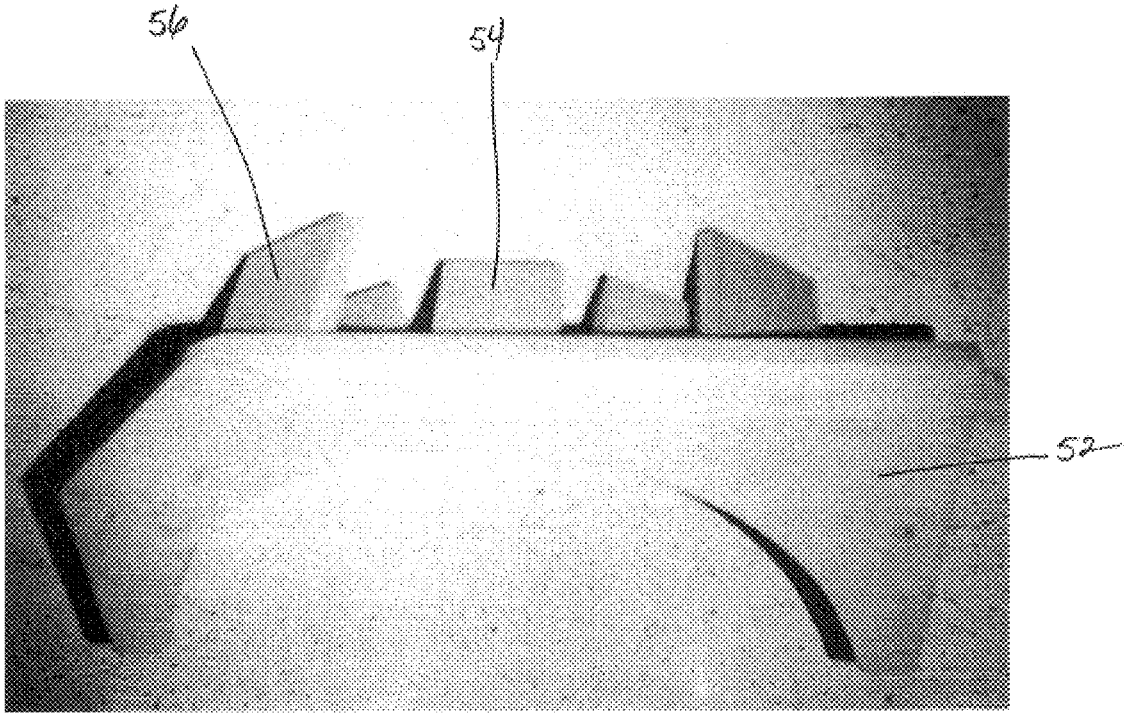
FIG. 8 shows a side view of the of bracket support and attachment means of the embodiment of the bracket assembly shown in FIG. 6.
Figure 9:
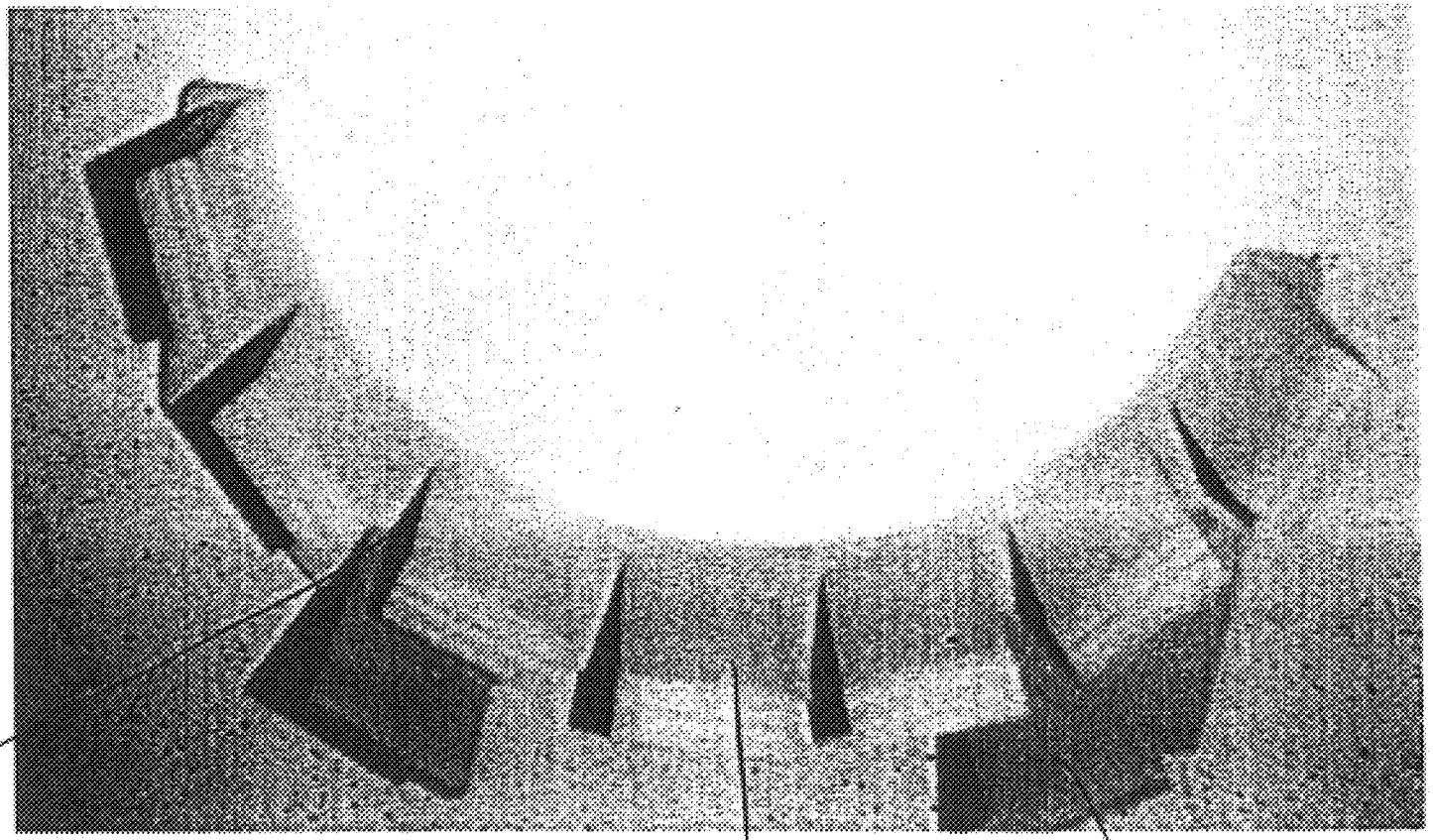
FIG. 9 shows a bottom view of the bracket support and attachment means of the embodiment of the bracket assembly shown in FIG. 6.
Figure 10:
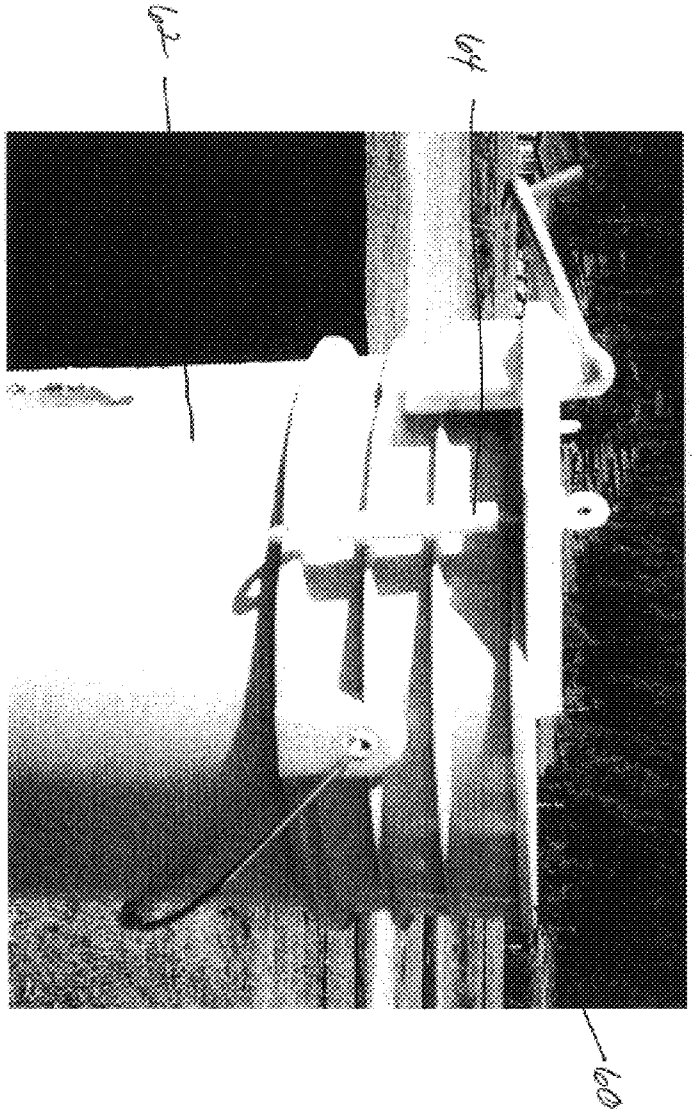
FIG. 10 shows a rear view of the embodiment of the bracket assembly shown in FIG. 6 on a five gallon bucket.

FIG. 5 is a side view which shows the position of the bracket third section 46 relative to the ladder rail 102, and the bracket fourth section 48 relative to the rail back surface 109. Also shown is the ladder step 110 including the top surface 112 and the front surface 114.

In use, the bracket assembly and container are attached to the ladder by moving the container rearward relative to the ladder. The ladder rail 102 is slid into the ladder rail receiving gap which separates the bracket third section 46 and the rail contact surface 26 of the lip. The bracket third section 46 is positioned above the step which is closest to the position on the ladder that the user desires the container to be located. When the ladder rail is entirely within the gap, the container is allowed to drop relative to the ladder. The continued downward movement of the container causes the clockwise rotation of the bracket relative to the container. The downward movement of the container causes the bracket third section 46 to rest onto the top surface 112 of the chosen step. The container moves downwardly a short distance until the ladder rail 102 is pinched between the bracket third section 26 and the rail contact surface 26 of the bracket support. At this position the container is allowed to tip (rotate counter clockwise) toward the ladder rail causing the bottom of the container to engage the ladder rail. The fourth section of the bracket 48 has also moved into engagement with the ladder rail back surface 109.

Removal of the container from the step simply involves the lifting of the container relative to the ladder. The bracket fourth section 48 disengages from the ladder separating the bracket third section 46 from the rail contact surface 26 which increases as the bracket rotates counter clockwise. Accordingly, the ladder rail is no longer be pinched between the bracket third section 46 and the rail contact surface 26. The container can then be freely moved forward relative to the ladder and repositioned on the ladder.

Typically the container 10 includes a substantially planar, substantially rectangular bottom and four substantially planar upstanding walls sections. Again, the four upstanding wall sections define the peripheral wall of the container. Typically, the entire container is a single molded piece. Other container shapes are, of course, possible.

Although the tray of the preferred version of the invention as shown in FIGS. 1 to 5 is shown designed specifically to accommodate a paint roller, the tray could be configured to accommodate other tools or hardware that could be used while on a ladder.

A five gallon bucket has become an indispensable tool. Buckets can now be fitted with aprons enabling tools to be strapped to their periphery. Further, stacking racks and dividers are available to compartmentalize the bucket allowing one to utilize its vast interior. Five gallon buckets are used by carpenters, painters, plumbers, and electricians. Much of the work done by these professionals is carried out on a ladder. The ability to securely attach a five gallon bucket to a ladder would greatly increase the utility of this new found tool. In another preferred embodiment, the bracket assembly of the subject invention is configured to allow a five gallon bucket to be removably attached to a ladder. The bracket and bracket support of the subject bracket assembly are secured to the bucket by attachment means. FIGS. 6–22 show preferred embodiments of attachment means useful in attaching the bracket and bracket support to a five gallon bucket.

In a preferred embodiment shown in FIGS. 6–12, the bracket support is a horizontal or near horizontal yoke 52. The yoke 52 has a rail contact surface 26. The bracket 40 is connected to the yoke 52 or bracket support by pivot supports 28, 30. Attachment means affix the bracket support 52 to the bucket. In this embodiment, the attachment means include walls 54, 56 extending downwardly from the yoke 52. The walls 54, 56 form a channel 58 to receive the rim 60 of the bucket 62. The yoke is secured to the bucket by turnbuckles 64 which are attached to the yoke. The turnbuckles grasp a ridge 66 near the middle of the bucket which is shown most clearly in FIG. 10.

Figure 13:
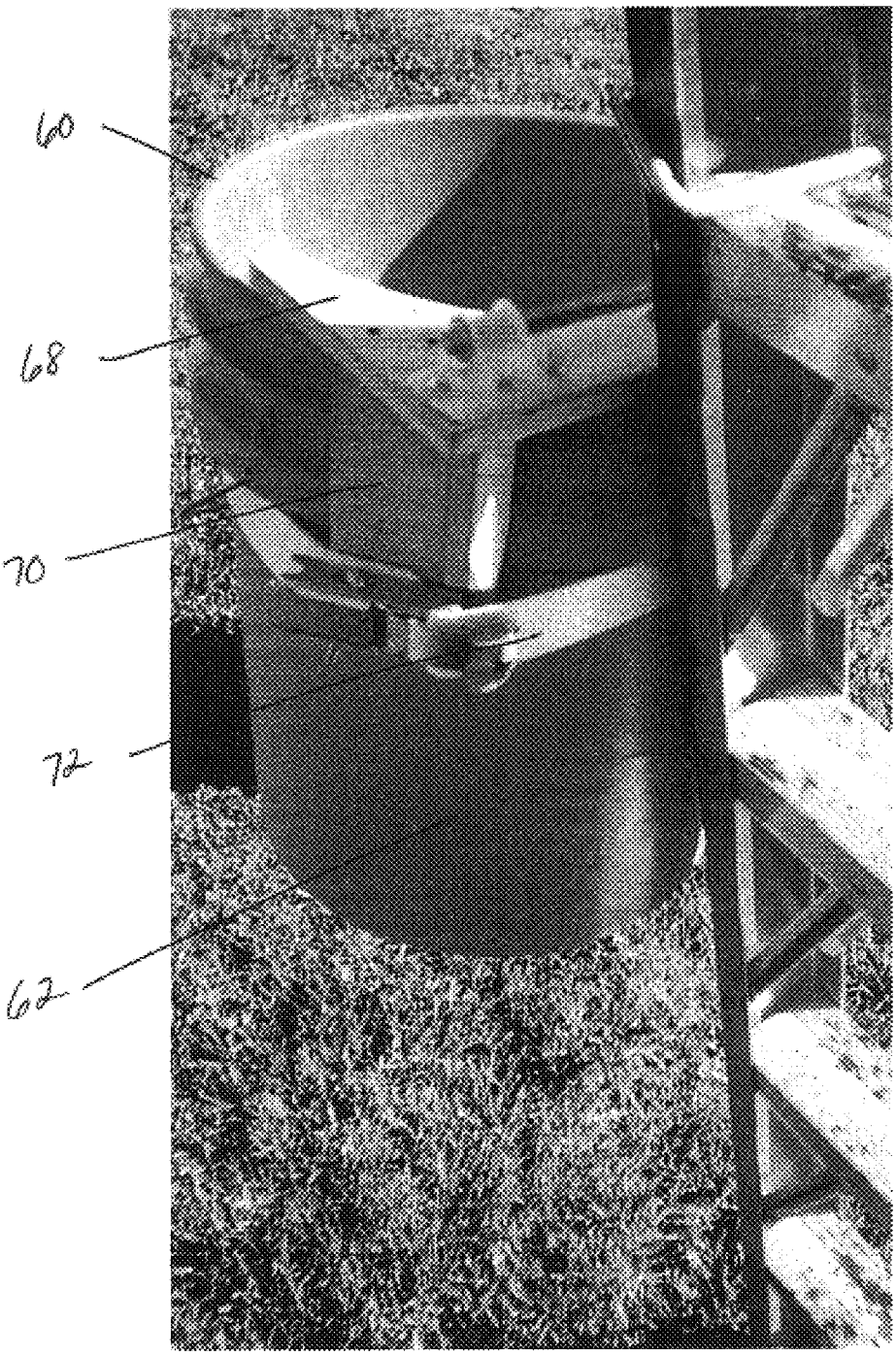
FIG. 13 shows another preferred embodiment of the bracket assembly of the subject invention.

Another preferred embodiment of the attachment means of the bracket assembly of the subject invention is shown in FIG. 13. A horizontal or near horizontal yoke 68 has downwardly extending walls 70 (not fully shown) that capture the open edge or the rim 60 of the bucket 62. A strap 72 encircles the walls 70 securing them to the bucket.

Figure 14:
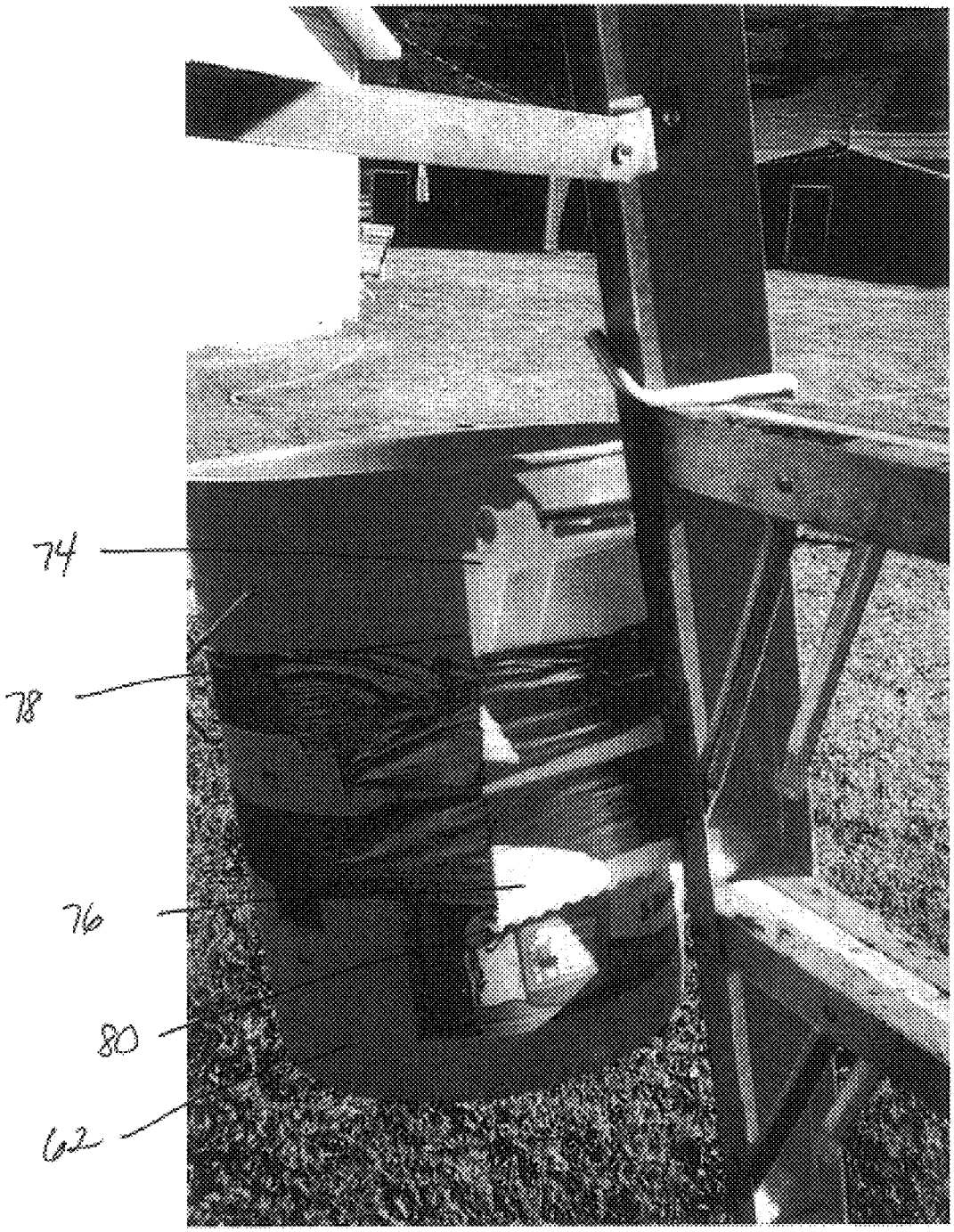
FIG. 14 shows another preferred embodiment of the bracket assembly of the subject invention.

Another preferred embodiment of the attachment means is shown in FIG. 14. A horizontal or near horizontal bracket support 74 has a downwardly extending wall 76 which contacts a side 78 of the container. In this embodiment, the wall 76 is taped to the bucket 62. It is noted however that the wall can likewise be strapped, clipped or buckled to the bucket. In a particularly preferred embodiment, the wall 76 has a short horizontal shelf 80 attached to the end of the vertical member distal the bracket support 74. This horizontal shelf 80 levels the bucket with the ground when the bucket is in place on the ladder.

Figure 15:
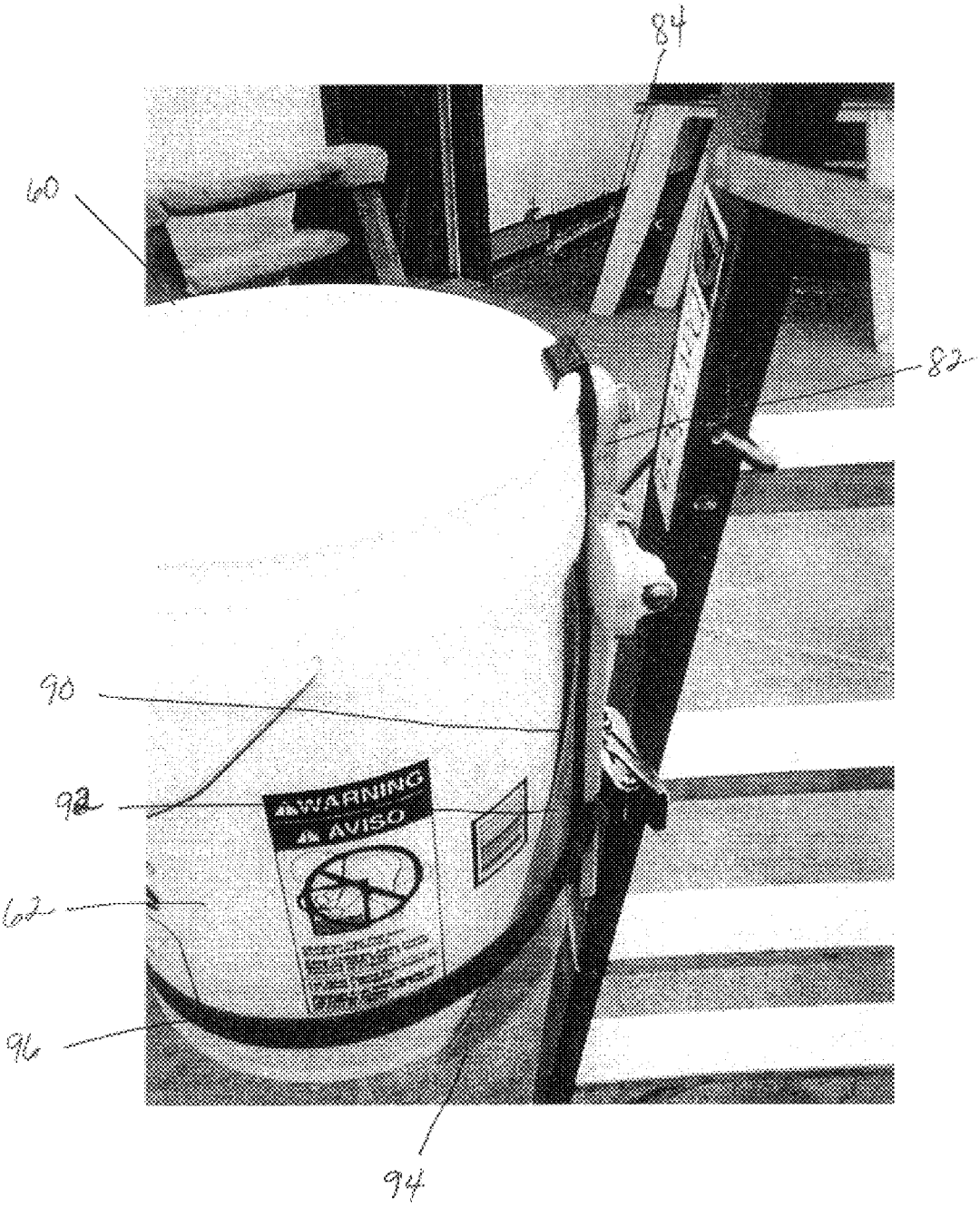
FIG. 15 shows another preferred embodiment of the bracket assembly of the subject invention.
Figure 16:
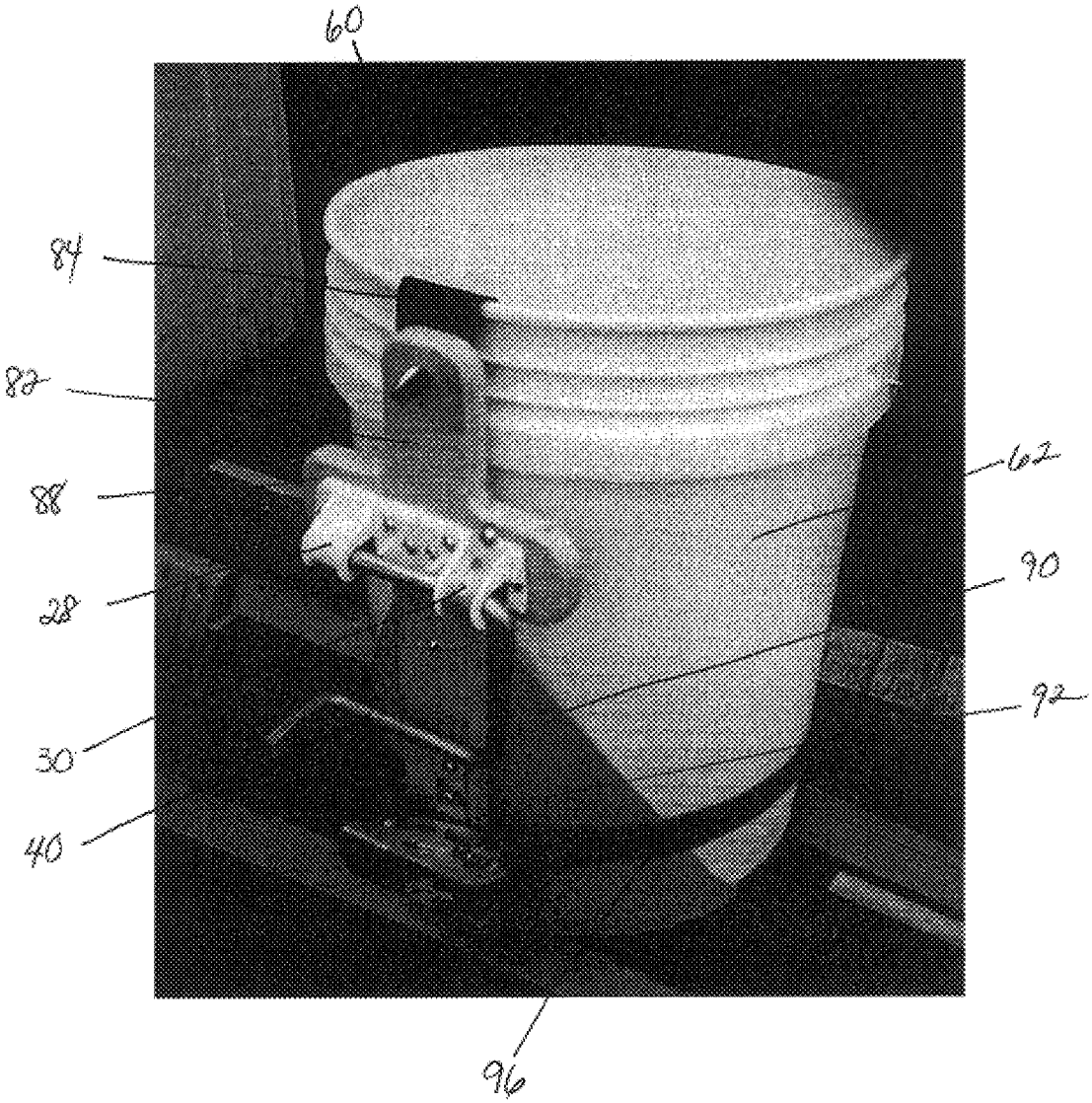
FIG. 16 shows a rear view of the embodiment of the bracket assembly shown in FIG. 15 on a five gallon bucket.

FIGS. 15 and 16 show another preferred embodiment of the attachment means of the bracket assembly of the subject invention. In this embodiment, the bracket support is in the shape of a cross 82. A clip 84 holds the top of the cross to the rim 60 of the bucket 62. The bracket 40 lays along the cross-member 88 of the cross and is captured within two pivot supports 28, 30. A shelf 90 is attached to the cross and has a vertical wall 92 and a horizontal wall 94. The bottom of the bucket is supported on the horizontal wall 94 of the shelf 90. A strap 96 secures the cross 82 to the bucket. In this embodiment, the strap is adjustable by ratcheting the strap around the bucket to the desired tightness. The strap however could be secured using other means, including but not limited to, buckles, ties and clasps, elasticized straps are likewise applicable.

Figure 17:
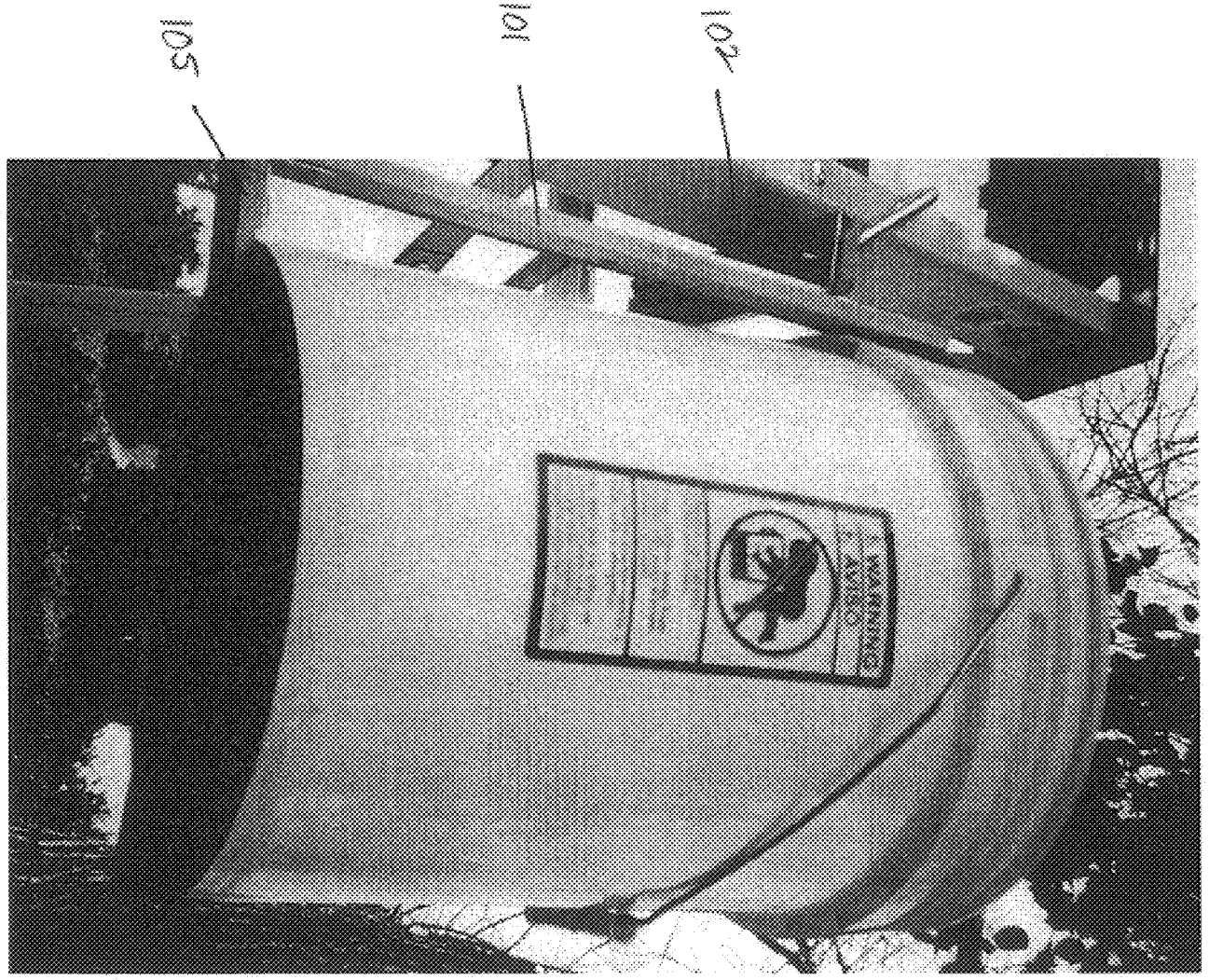
FIG. 17 shows a bottom perspective view of another preferred embodiment of the bracket assembly of the subject invention.
Figure 18:
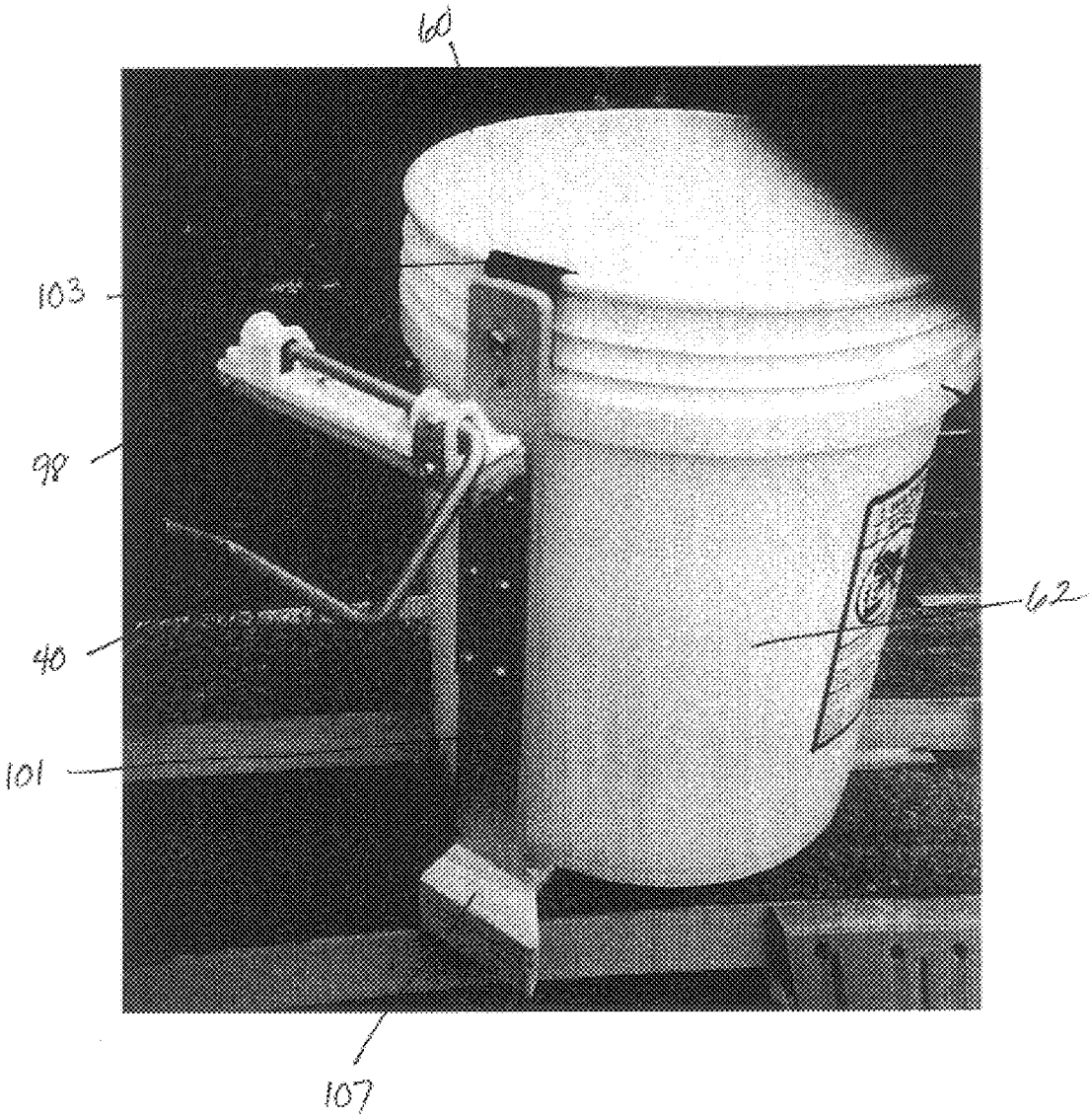
FIG. 18 shows a side view of the embodiment of the bracket assembly shown in FIG. 17.

Another preferred embodiment of the bracket assembly of the subject invention is shown in FIGS. 17–18. In this embodiment, the bracket 40 is pivotally mounted to a horizontal or near horizontal bracket support 98. The support 98 attaches to a vertical member 101. In a preferred embodiment, the bracket support 98 is attached to the vertical member 101 by an L-bracket insuring a stout connection. A clip 103 clasps the rim 60 of the bucket 62. A base support 105 extends horizontally from the end of the vertical member distal the bracket support to hold the bottom of the bucket. A spacer 107 at the distal end of the vertical member is positioned opposite the base support 105. The spacer 107 contacts the rail 102 of the ladder and levels the bucket with the ground when it is in place on the ladder.

Figure 19:
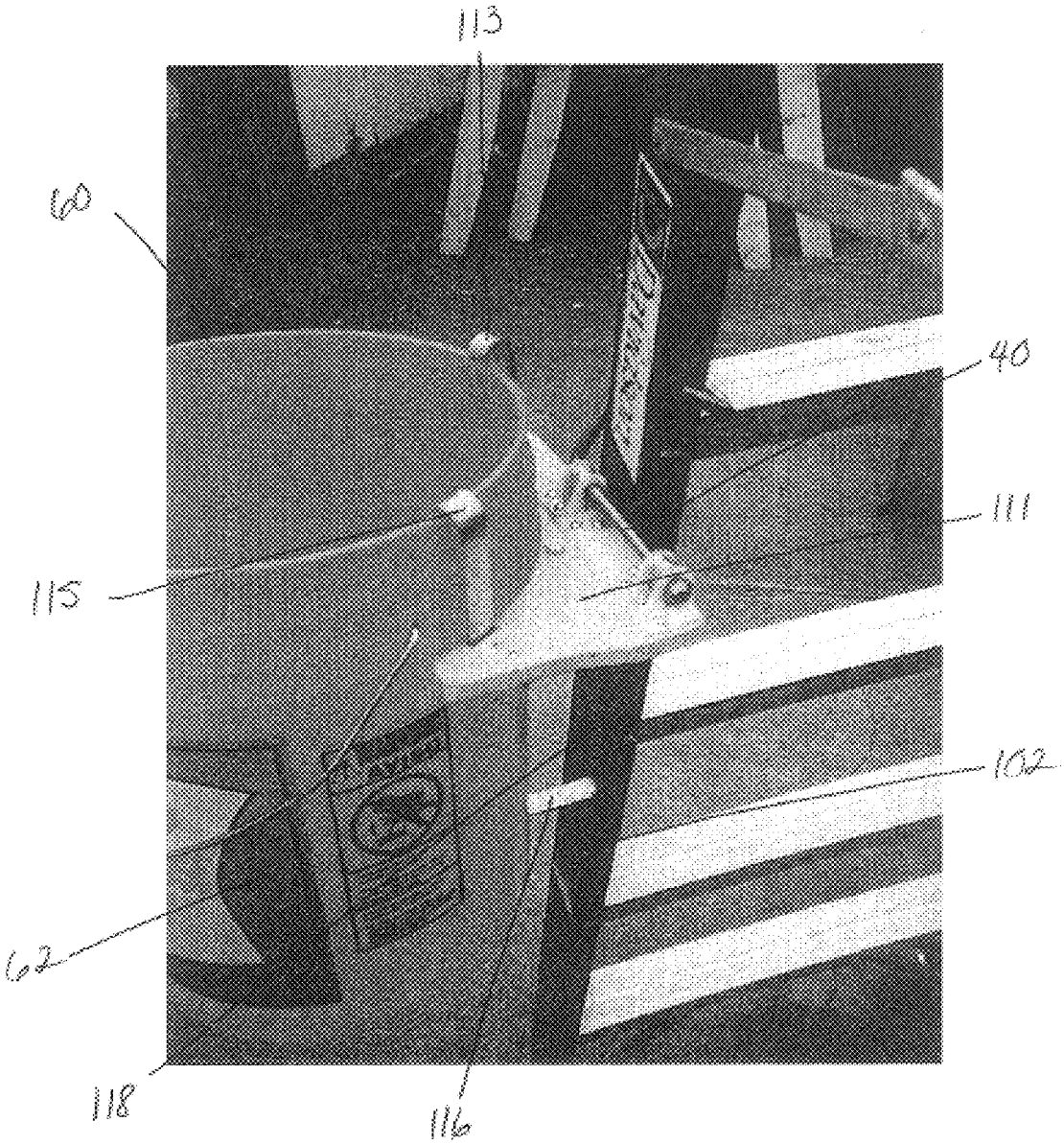
FIG. 19 shows another preferred embodiment of the bracket assembly of the subject invention.
Figure 20:
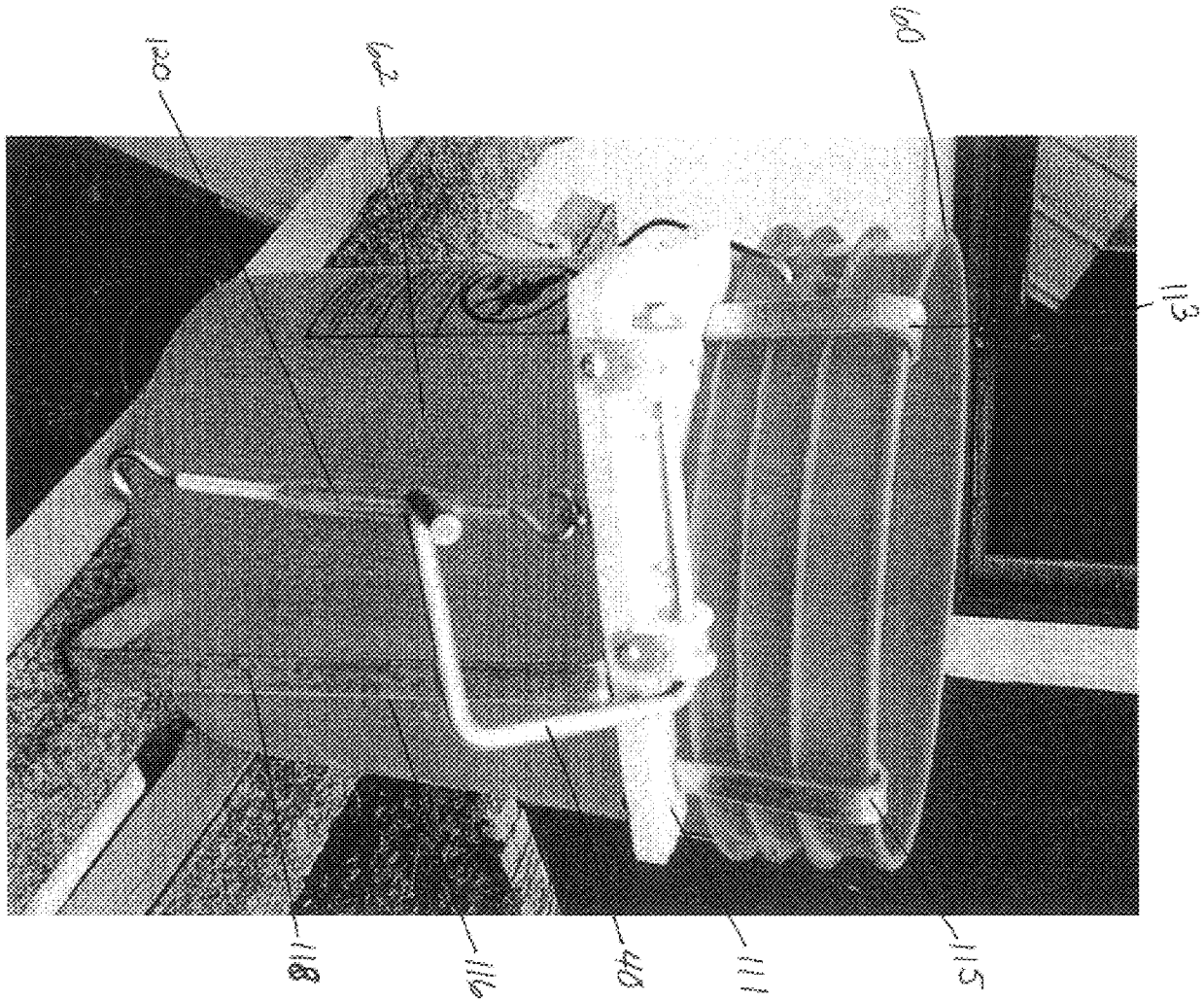
FIG. 20 shows a rear view of the embodiment of the bracket assembly shown in FIG. 19 on a five gallon bucket.

In another preferred embodiment, the bracket support is a collar 111 to which the bracket 40 is pivotally attached (FIGS. 19–20). The collar cups a side of the bucket. Clips 113, 115 attached to the collar 111 grasp the rim 60 of the bucket 62. An L-bracket 116 extends downwardly from the collar to support the bottom of the bucket. The leg of the L 118 rests upon the rail 102 of the ladder stabilizing the bracket support. FIG. 20 shows that a turnbuckle 120 can be used to further secure the bucket to the bracket support.

Figure 21:
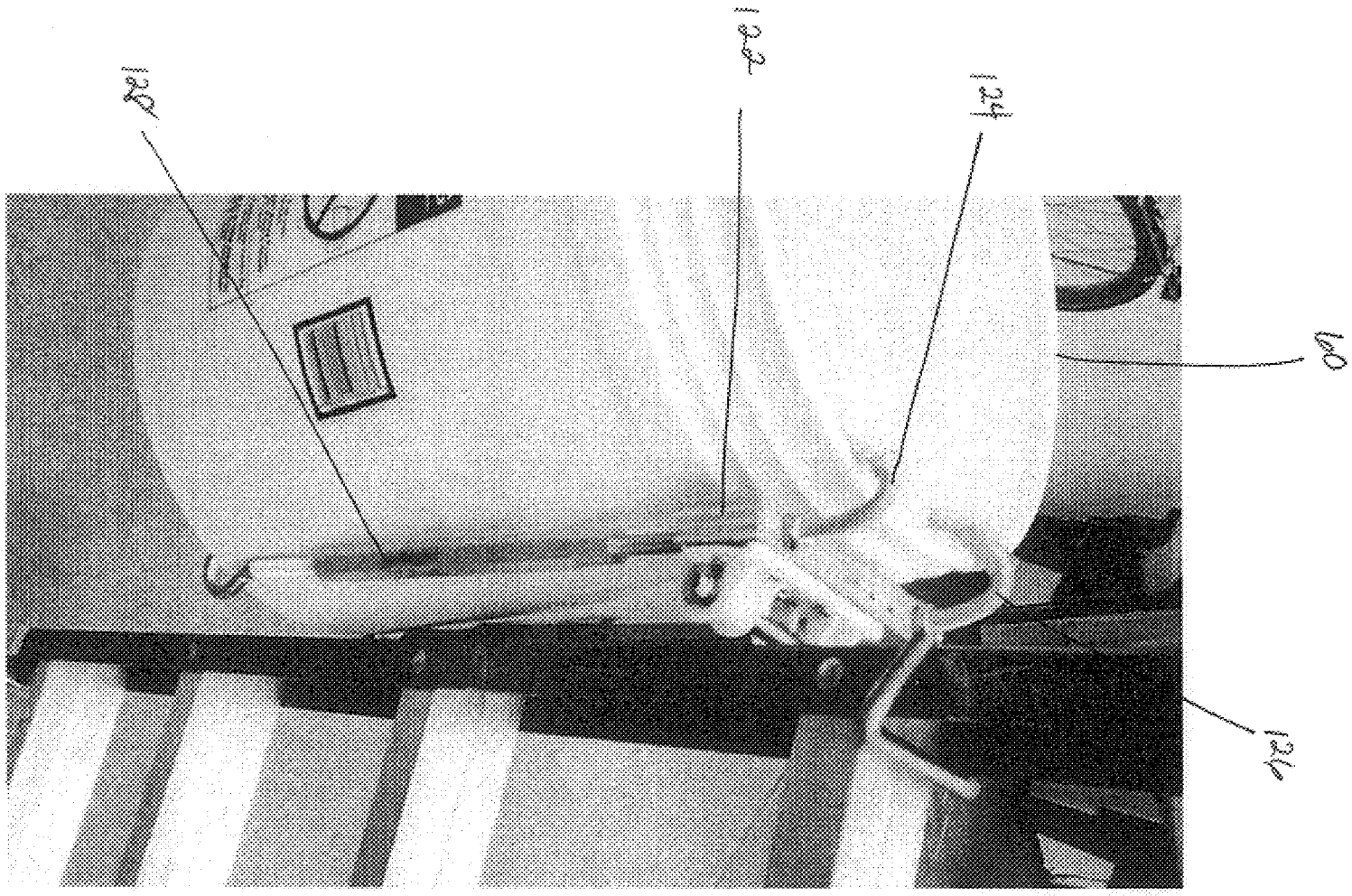
FIG. 21 shows another preferred embodiment of the bracket assembly of the subject invention.
Figure 22:
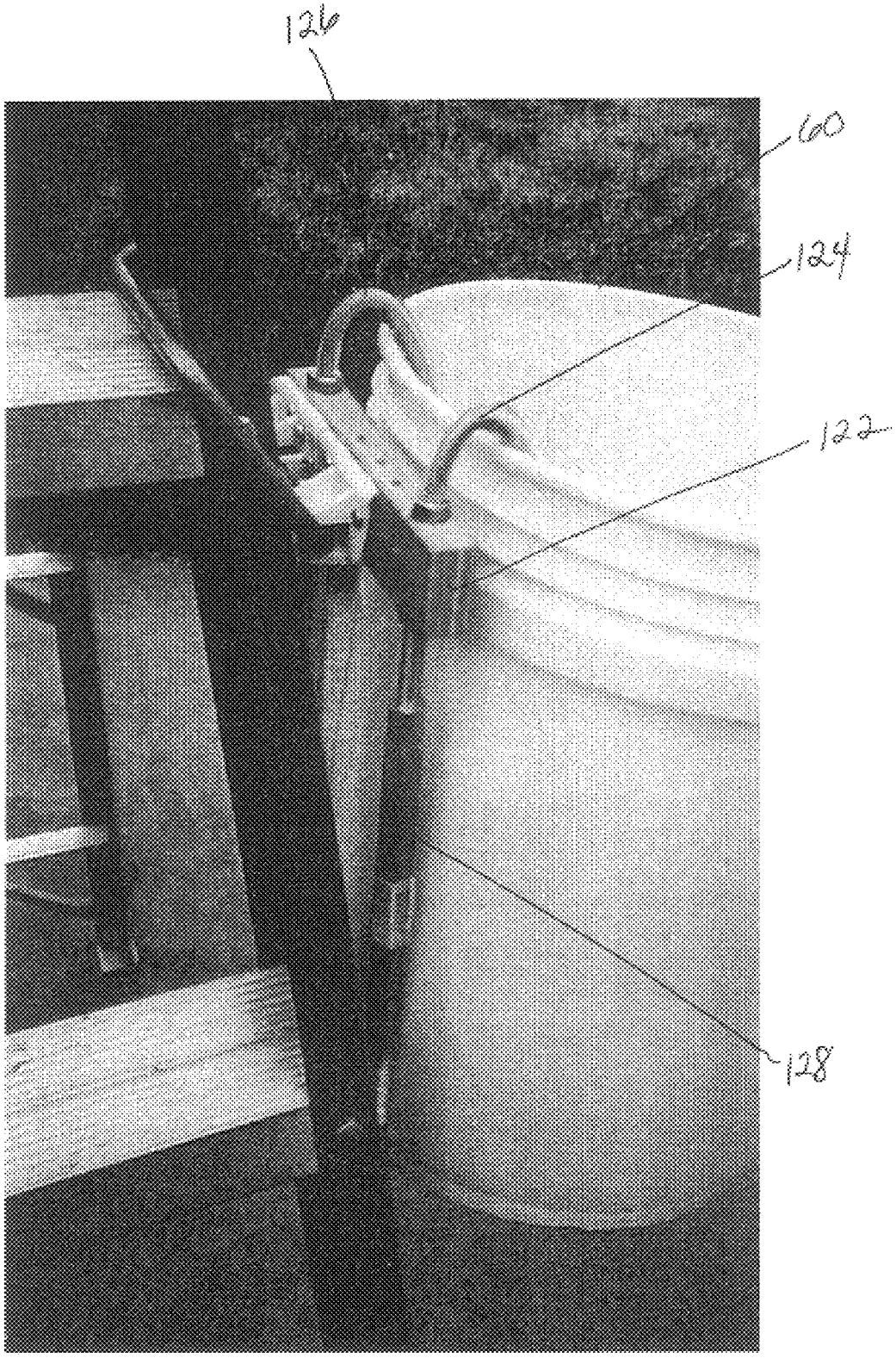
FIG. 22 shows a rear perspective view of the embodiment of the bracket assembly shown in FIG. 21.

FIGS. 21 and 22 show another preferred embodiment of the attachment means of the bracket assembly of the subject invention. A vertical bracket support 122 is attached to the rim 60 of the bucket by hooks 124, 126. Turnbuckles 128 extending from the bottom of the support 122 hook the bottom of the bucket securely affixing the bucket to the bracket support.

Figure 11:
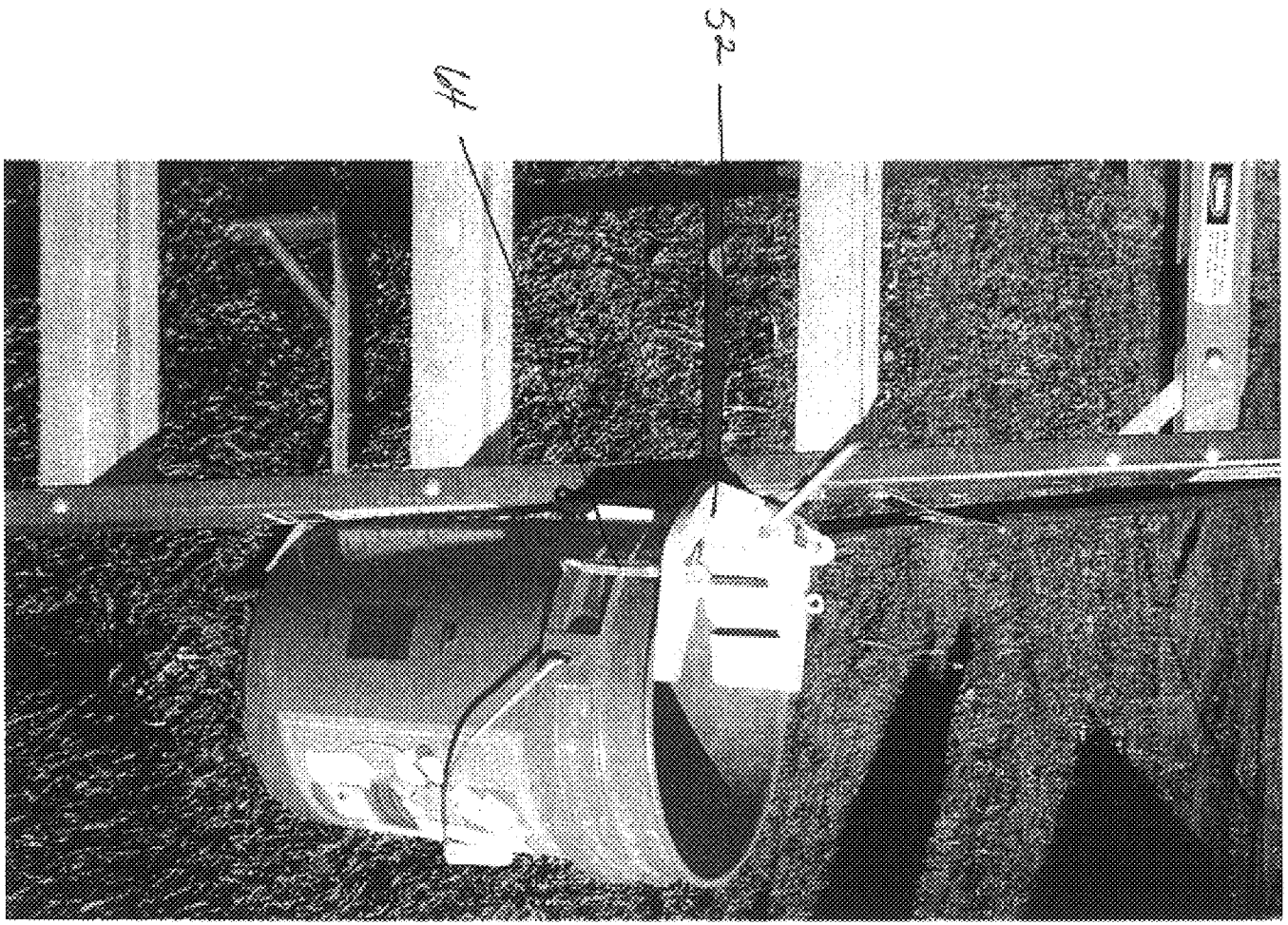
FIG. 11 shows a side view of the embodiment of the bracket assembly shown in FIG. 6 on a five gallon bucket and attached to a ladder.
Figure 12:
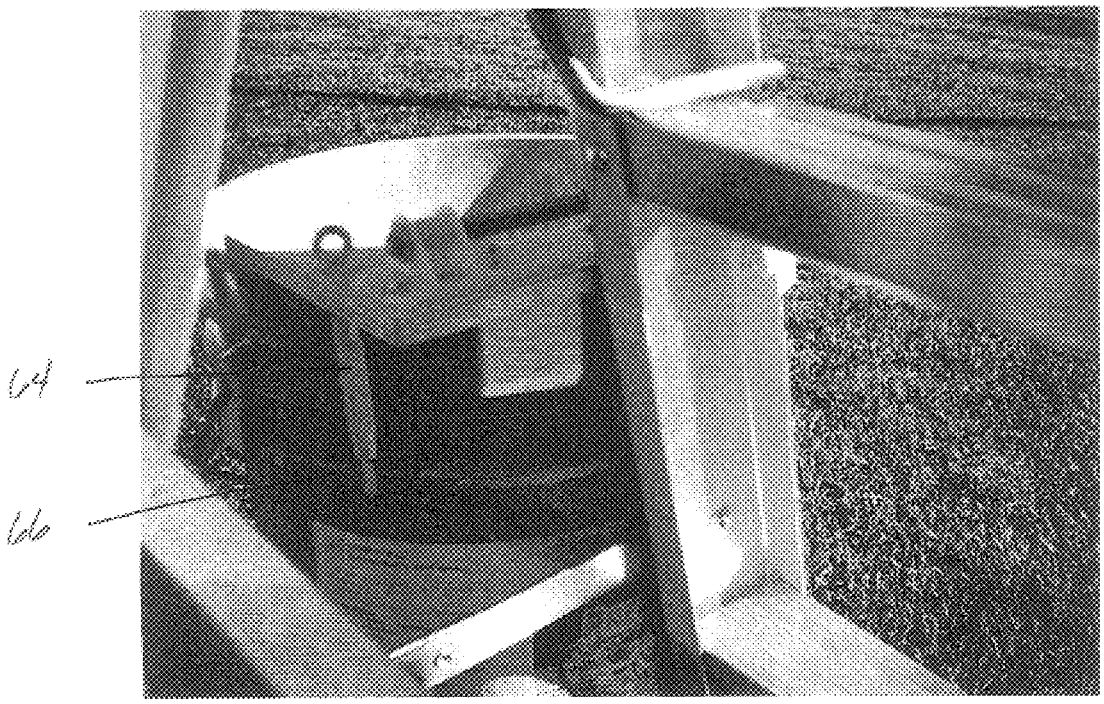
FIG. 12 shows a rear view of the embodiment of the bracket assembly shown in FIG. 6 on a five gallon bucket and attached to a ladder.

In use, the bracket and bracket support are affixed to the container or bucket with the attachment means. For example, in the preferred embodiment shown in FIGS. 6–12, the downwardly extending walls 54, 56 are placed over the rim 60 of the bucket which is captured within the channel 58 (FIG. 11). The bracket assembly is secured to the bucket by the turnbuckles 64 which hook a ridge 66 of the bucket. To attach the bucket and bracket assembly to a ladder, the ladder rail 102 is slid into the ladder rail receiving gap. The bracket third section 46 is positioned above the step 110 of the ladder which is closest to the position on the ladder that the user desires the bucket to be located. When the ladder rail 102 is entirely within the gap, the bucket and bracket assembly are allowed to drop relative to the ladder. The downward movement of the bucket causes the bracket to rotate relative to the bucket. The third section 46 comes to rest onto the top surface 112 of the chosen step. As the bucket moves downward a short distance further, the fourth section of the bracket 48 moves into engagement with the ladder rail back surface 109 (FIG. 12) and the edge of the bracket support contacts the side of the ladder rail.

Removal of the bucket and bracket assembly from the ladder simply involves the lifting of the bucket relative to the ladder. The bracket fourth section 48 disengages from the ladder rail back surface 109 and the ladder rail can be slipped out of the rail receiving gap. The bucket and bracket assembly can then be freely moved and repositioned on the ladder.

The bracket assembly of the subject invention allows any container to be conveniently attached to the side of a ladder. Although the exemplified embodiments show the bracket assembly securing only an integral container or a five gallon bucket to a ladder, the versatile attachment means allow any bucket to be removably affixed to a ladder. Further, the exemplified embodiments show the bracket assembly attached to only a few types of ladders, it is important to note however that the subject bracket assembly mounts and dismounts easily to different types of ladders, and will securely mount to a step ladder, to an extension ladder when fully extended, or to an extension ladder in a position when the ladder sections are overlapping. The bracket third section is the only portion of the container that contacts the ladder step and will contact or rest upon any configuration of step equally. The bracket assembly mounts the container laterally outwardly from the ladder so as not to interfere with the normal operation of the ladder. It also allows the user to mount the container with one hand only and includes no fasteners and additionally includes no means that obstruct the user from accessing the interior of the container.

It is understood that the foregoing examples are merely illustrative of the present invention. Certain modifications of the articles and/or methods employed may be made and still achieve the objectives of the inventions. Such modifications are contemplated as within the scope of the claimed invention.

What is claimed is:

1. A bracket assembly for attaching a container to a ladder, the bracket assembly comprising:

a bracket support, the support comprising a rail contact surface, and at least one pivot support;

a bracket disposed within the at least one pivot support on the bracket support, the bracket including, a first section disposed within the pivot support and freely rotatable within the pivot support, a second section extending from the first section and a third section extending rearwardly from the second section in a direction substantially parallel to the first section, the first section, the second section and, the third section form a generally U-shaped body member defining a plane, the third section disposed outwardly from the rail contact surface of the bracket support at a spaced apart lateral distance from the rail contact surface of the bracket support, the spaced apart distance defining a ladder rail receiving gap, a fourth section disposed at the distal end of the bracket and extending from the third section at substantially a right angle to the third section and extending upwardly out of the plane defined by the U-shaped body member; and container attachment means to attach a container to the bracket support, the container attachment means comprising at least one selected from the group consisting of a clip to engage a rim of the container, non-elastic straps, elasticized straps, tape and turnbuckles;

wherein the bracket is freely rotatable within the pivot support from at least a first position, to a second position where the second section has rotated upwardly, and the lateral distance between the third section and the rail contact surface has shortened, and whereby upon disposal of the container attached to the bracket assembly on the ladder the ladder rail is disposed within the rail receiving gap and the bracket is rotated to the second position wherein the ladder rail is pinched between the rail contact surface of the support and the bracket third section, and the bracket third section rests atop a step of the ladder.

2. The bracket assembly of claim 1, wherein the bracket is permanently disposed within the pivot support of the bracket support.

3. The bracket assembly of claim 1, wherein each at least one pivot support comprises a loop within which the bracket first section is disposed.

4. The bracket assembly of claim 1, wherein the bracket first, second, and third sections define a "U" shape.

5. The bracket assembly of claim 1, wherein said rail contact surface is a spacer and whereby the spacer is adapted to level said container with the ground when said container is in place on said ladder.

6. The bracket assembly of claim 1, wherein said bracket support is a yoke having downwardly extending walls which form a channel to capture a rim of said container.

7. The bracket assembly of claim 6, wherein said container attachment means include turnbuckles to attach said container to said bracket support.

8. The bracket assembly of claim 6, wherein said container attachment means include a strap encircling said downwardly extending walls and said container to attach said container to said bracket support.

9. The bracket assembly of claim 1, wherein said bracket support is a horizontal shelf with a downwardly extending wall.

10. The bracket assembly of claim 9, wherein said container attachment means include a strap adapted to encircle said downwardly extending wall and said container to attach said container to said bracket support.

11. The bracket assembly of claim 1, wherein said bracket support is a cross.

12. The bracket assembly of claim 11, wherein said bracket is disposed on a cross-piece of said cross; and wherein said container attachment means comprises a clip adapted to hold said bracket support to a rim of said container, a shelf adapted to support a bottom of said container and a strap adapted to encircle said bracket support and said container to attach said container to said bracket support.

13. The bracket assembly of claim 1, wherein said bracket support is an L-bracket with a vertical member on which said bracket is disposed.

14. The bracket assembly of claim 13, wherein said container attachment means includes a clip adapted to hold said bracket support to a rim of said container, and wherein a foot of said L-bracket is adapted to support a bottom of said container.

15. The bracket assembly of claim 1, wherein said bracket support is a yoke.

16. The bracket assembly of claim 15, wherein said container attachment means include an L-bracket adapted to support a bottom of said container, a turnbuckle adapted to connect said yoke to the bottom of said container and at least one clip adapted to attach said yoke to a rim of said container.

17. The bracket assembly of claim 1, wherein said container attachment means further comprises a shelf to support a bottom of said container.

* * * * *